United States Patent [19]

Yajima et al.

[11] 4,271,453

[45] Jun. 2, 1981

[54] IGNITER WITH COUPLING STRUCTURE

[75] Inventors: Tadashi Yajima, Akigawa; Makoto Yagi, Ohme; Masayoshi Katoh, Kawagoe; Takashi Ishii, Tokyo; Haruki Maruizumi, Hidaka; Tadahiko Nagaoka, Sayama

[73] Assignees: Nissan Motor Company, Limited; Japan Aviation Electronics Industry, Limited, both of Japan

[21] Appl. No.: 49,463

[22] Filed: Jun. 18, 1979

[30] Foreign Application Priority Data

Jul. 1, 1978 [JP] Japan ..... 53/79245

[51] Int. Cl.[3] ..... F23Q 7/00

[52] U.S. Cl. ..... 361/248; 102/202.2; 102/202.3; 102/202.9; 219/270; 361/264; 431/263; 200/61.58 R

[58] Field of Search ..... 361/248, 249, 250, 251, 361/252, 263, 264, 265, 266; 431/75, 262, 263; 102/28 R, 206, 203; 200/61.58 R

[56] References Cited

U.S. PATENT DOCUMENTS

| | | | |
|---|---|---|---|
| 2,064,706 | 12/1936 | Wiggert | 361/248 |
| 2,279,451 | 4/1942 | English et al. | 102/10 |
| 2,741,179 | 4/1956 | Taylor et al. | 361/248 X |
| 2,987,997 | 6/1961 | Ireland, Jr. | 102/28 R |
| 3,022,446 | 2/1962 | Irish, Jr. | 361/248 X |
| 3,139,558 | 6/1964 | Lindberg | 361/266 |
| 3,274,937 | 9/1966 | Kyle | 102/203 |
| 3,376,817 | 4/1968 | Vilbajo | 102/28 R |
| 3,569,787 | 3/1971 | Palmer | 361/264 X |
| 3,577,209 | 5/1971 | Perkins | 361/264 |
| 3,735,705 | 5/1973 | Hudson, Jr., et al. | 102/28 R |
| 3,742,601 | 7/1973 | Raffaslli et al. | 29/611 |
| 3,809,964 | 5/1974 | Ceyrat | 102/28 R |
| 4,106,074 | 8/1978 | Conne | 361/248 |

*Primary Examiner*—Volodymyr Y. Mayewsky
*Attorney, Agent, or Firm*—Lane, Aitken, Ziems, Kice & Kananen

[57] ABSTRACT

An igniter is disclosed having a heat generator responsive to an ignition signal for igniting powder. comprises a first connector insulatingly supporting a first pair of electrical conductions having their one ends connected across the heat generator, filter means provided in circuit with one cf the first electrical conductors for prohibiting passage of any high frequency signal other than the ignition signal, resilient means electrically connecting the first electrical conductors, the resilient means resiliently contacting at least one of the first electrical conductors, a second connector insulatingly supporting a second pair of electrical conductors having their one ends connected across an ignition signal source, and a second connector adapted to engage the first connector so as to bring the second electrical conductors into electrical connection with the respective first electrical conductors and to take the resilient means out of contact with the first electrical conductor.

4 Claims, 12 Drawing Figures

IGNITER WITH COUPLING STRUCTURE

BACKGROUND OF THE INVENTION

1. Field of the Invention

This invention relates to an igniter having a heat generator responsive to an ignition signal to ignite powder and to a coupling structure for such an igniter.

2. Description of the Prior Art

FIG. 1 is a sectional view illustrating a conventional coupling structure for use with an igniter having a heat generator responsive to an ignition signal to ignite powder, with its female connector shown in full engagement with its male connector. The male connector 1 has a pair of male electrical conductors 2 and 3 separately extending through an insulating support 4 into a powder container 5. A heat generator 6 is connected between the male conductors 2 and 3 within the powder container 5. The female connector 7 has a pair of female electrical conductors 8 and 9 supported and electrically insulated from each other by an insulating support 10. The one ends of the female conductors are connected through a switch 11 to a suitable ignition signal source 12.

With such a conventional coupling structure, an additional separate filter 13 has been required in order to prevent occurrence of malfunction to actuate the igniter to ignite powder due to high frequency induction caused by wave impact or thunder. However, the effect of the filter 13 decreases as the distance between the heat igniter and the filter 13 increases.

Furthermore, it has been required to prevent a flow of static electricity charged on the male electrical conductors 2 and 3 caused by a human body or other substances contacting the male connector 1 while the igniter is out of use. FIG. 1B is a sectional view showing a shorting cap which has been used for this purpose. The shorting cap 15 is engaged with the male connector 1 to electrically connect the male electrical conductors 2 and 3 through a conductive wire 16. However, this requires an operator to remove or engage the shorting cap 15 from the male connector 1 every time the igniter is required to be placed into or out of operation.

SUMMARY OF THE INVENTION

It is therefore one object of the present invention to provide a compact coupling structure which will be free from the above-mentioned disadvantages found in conventional coupling structures.

Another object of the present invention is to provide an improved coupling structure in which a pair of electrical conductors contained in a first connector can automatically be connected or disconnected upon disengagement or engagement of a second connector with the first connector.

Still another object of the present invention is to provide a coupling structure which can prevent occurrence of malfunction of an associated igniter.

Other objects, means, and advantages of the present invention will become apparent to one skilled in the art thereof from the following description.

BRIEF DESCRIPTION OF THE DRAWINGS

The following explanation of one preferred embodiment of the present invention will help in the understanding thereof, when taken in conjunction with the accompanying drawings, which, however, should not be taken as limiting the present invention in any way, but which are given for purposes of illustration only. In the drawings, like parts are denoted by like reference numerals in the several figures, and.

DESCRIPTION OF THE PREFERRED EMBODIMENT

Figure 1A:
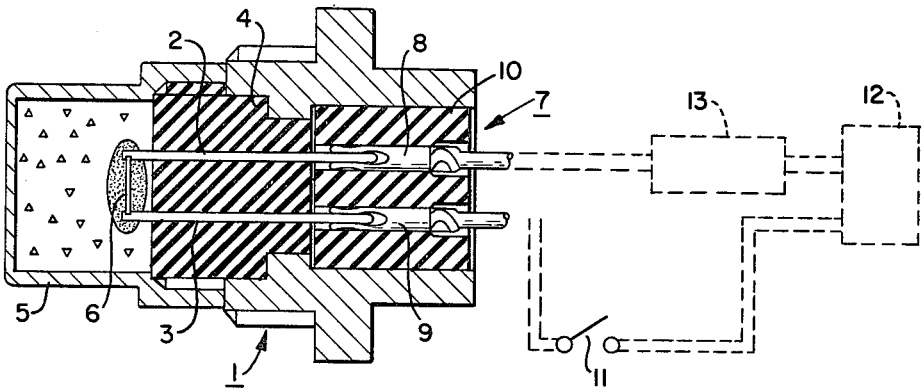
FIG. 1A PRIOR ART
FIGS. 1A and 1B are sectional views showing a conventional coupling structure.
Figure 1B:
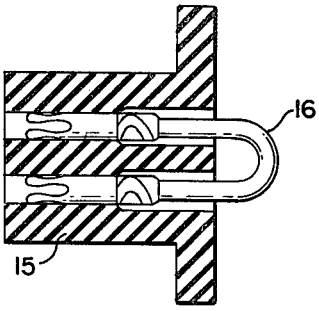
FIG. 1B PRIOR ART
Figure 1A:
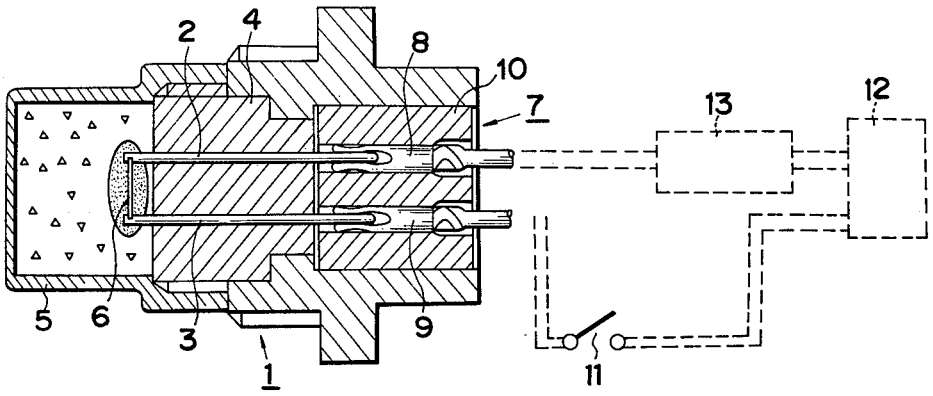
Figure 1B:
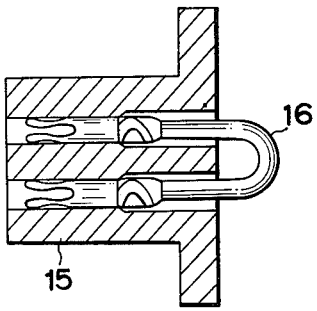
Figure 2A:
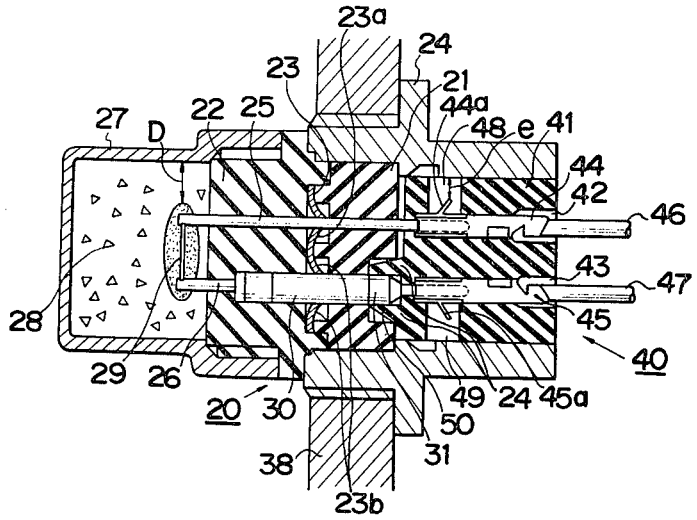
FIGS. 2A and 2B are sectional views showing one embodiment of the coupling structure of the present invention.
Figure 2B:
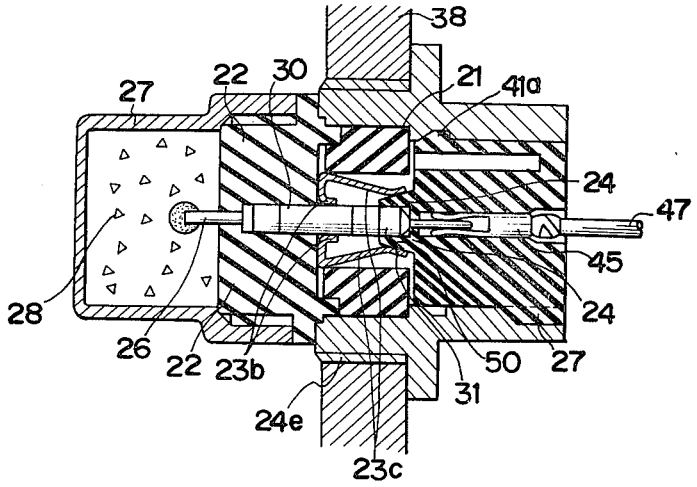

Referring now to FIGS. 2A and 2B, there is illustrated one embodiment of a coupling structure made in accordance with the present invention. The coupling structure comprises a first connector 20 (male connector) which includes an electrical conductor support assembly made up of front and rear pin insulators 21 and 22 and a spring member 23 held between the first and second pin insulators 21 and 22. The electrical conductor support assembly is contained within a metal shell 24. The pin insulators 21 and 22 are formed of electrically insulating material and the spring member 23 is made by piercing and notching a resilient metal plate. A pair of male electrical conductors 25 and 26 extend through the conductor support assembly into a powder container 27 formed of metal or synthetic resin for containing therein powder 28. The powder container 27 is secured to the metal shell 24 such as by screwing or caulking. A heat generator 29, which may take the form of a platinum wire, is connected between the male electrical conductors 25 and 26 within the powder container 27. The first or male connector 20 also includes a filter 30 provided in circuit with of the male conductor 26 for prohibiting passage of any high frequency signal other than the ignition signal fed through the male contact 26.

Figure 3:
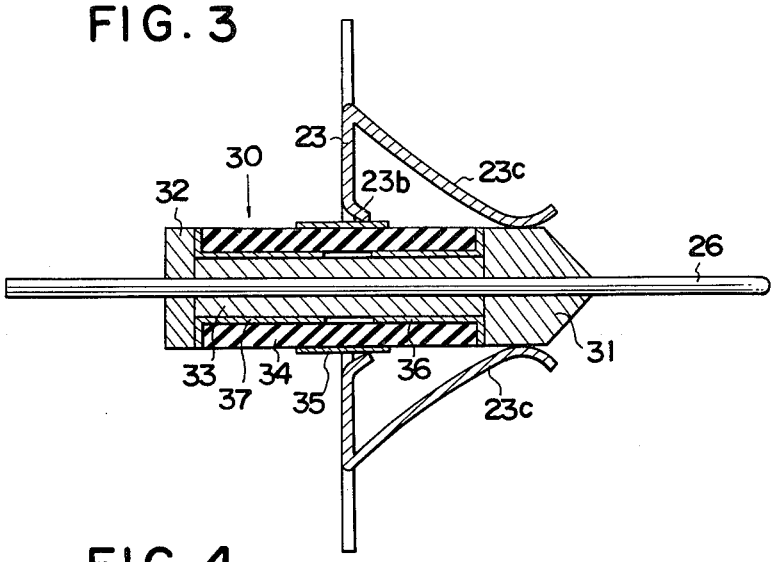
FIG. 3 is a sectional view showing the detail of the filter incorporated in the coupling structure of FIGS. 2A and 2B.

Referring to FIG. 3, the filter 30 will be described in greater detail. The filter 30 is made up of front and rear metal members 31 and 32, a magnetic core 33 formed of a magnetic material such as ferrite and held between the front and rear metal members 31 and 32, a dielectric hollow cylinder 34 surrounding the magnetic core 33, a first electrode 35 placed on the outer periphery of the dielectric cylinder 34, a second electrode 36 having an annular portion placed between the magnetic core 33 and the dielectric cylinder 34 with a flange placed against one end surface of the dielectric hollow cylinder 34, and a third electrode 37 an annular portion placed between the magnetic core 33 and the dielectric cylinder 34 and spaced away from the annular portion of the second electrode 36 with a flange placed on the other end surface of the dielectric hollow cylinder 34. The electrodes 35 to 37 may be formed by coating silver on the corresponding areas. The male conductor 26 extends through the front metal member 31, the magnetic core 33 and the rear metal member 32 so that the magnetic core 33 surrounds the male conductor 26.

The spring member 23 has a louvered edge 23*a* (FIG. 2A) around the hole through which the male conductor 25 extends and a louvered edge 23*b* around the hole through which the filter 30 extends. The louvered edge 23*a* contacts with the male conductor 25 and the louvered edge 23*b* contacts with the first electrode 35 of the filter 30. The spring member 23 also has inwardly-turned portion 23*c* in resilient contact with the front metal member 31 so as to make an electrical connection between the male conductors 25 and 26 through the spring member 23. This electrical connection is broken when a second conductor to be described later is engaged with the first connector 20.

Figure 4:
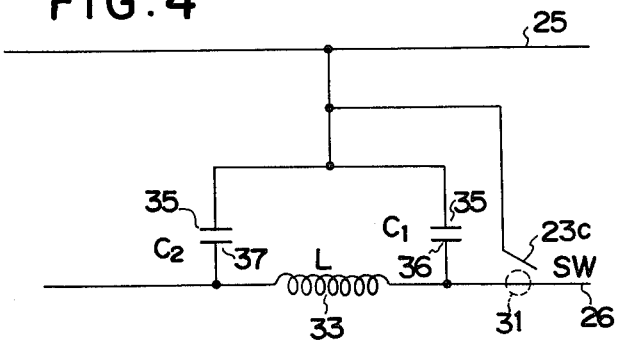
FIG. 4 is a circuit diagram showing an equivalent circuit of the filter of FIG. 3.

FIG. 4 shows and equivalent circuit of the filter 30. The male electrical conductor 26 centrally extending through the filter 30, constitutes an inductance L together with the magnetic core 33 surrounding the male contact 26. The first and second electrodes 35 and 36 constitute a capacitance C1 together with the dielectric cylinder 34 and the first and third electrodes 35 and 37 constitute a capacitance C2 together with the dielectric cylinder 34. The first electrode 35 is connected through the spring member 23 with the male electrical conductor 25 and the second and third electrodes 36 and 37 are connected through the metal members 31 and 32 with the male electrical conductor 26. The portions 23*c* of the spring member 23 and the front metal member 31 serve as the contacts of a switch Sw which is closed when a second connector to be described later is out of engagement with the first connector 20 and which is open when the second connector is in full engagement with the first connector 20.

Figure 5A:
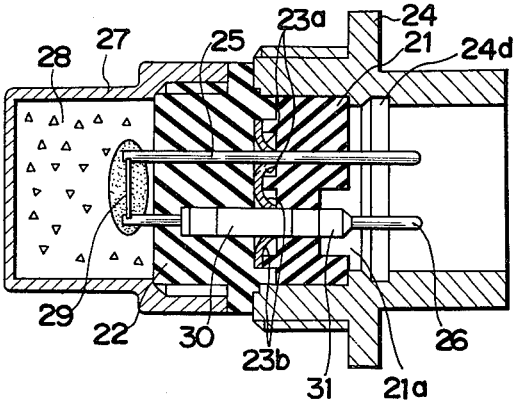
FIGS. 5A and 5B are sectional views showing the male connector of the coupling structure.
Figure 5B:
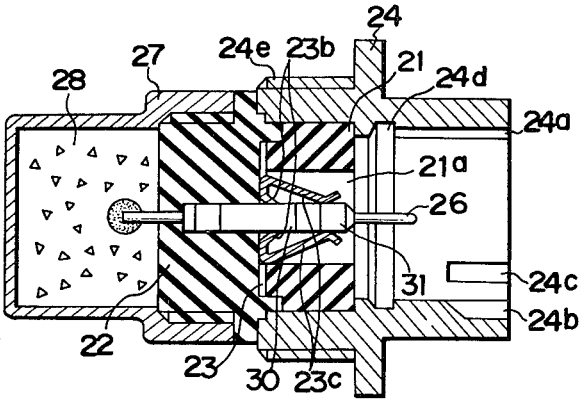

Referring to FIGS. 5A and 5B, the first connector 20 will be further described. The front pin insulator 21 is formed with a recess 21*a* for free movement of the inwardly-turned portions 23*c* of the spring member 23. The metal shell 24 is formed on its inner surface with longitudinally-extending guide grooves 24*a*, 24*b* and 24*c* and with a circumferential groove 24*d*. The metal shell 24 is also formed on its outer periphery with a threaded portion 24*e* which is engaged with a support 38 by turning the metal shell 24 with the use of a tool fitted in the grooves 24*a* and 24*b*.

Referring back to FIGS. 2A and 2B, the coupling structure also comprises a second connector 40 including an insulating socket 41 which is formed with two longitudinally-extending conductor holes 42 and 43 in which two resilient-plate-made tubular female electrical conductors 44 and 45 are inserted, respectively. The female conductors 44 and 45 are connected through respective wires 46 and 47 across an ignition signal source. The insulating socket 41 is also formed with passages 48 and 49 transversely outwardly extending from the conductor holes 42 and 43, respectively. The female conductors 44 and 45 have outwardly-turned portions 44*a* and 45*a* which extend in the passage 48 and 49, respectively, so as to prevent the female electrical conductors from working out of the contact holes. The passages 48 and 49 also serve to form spaces between the metal shell 24 of the first connector 20 and the female electrical conductors 44 and 45 for discharging static electricity when a high voltage or static electricity is applied to the male conductor 25 or 26. That is, even if the powder container 27 is formed of metal and a high voltage or static electricity is applied to the male conductor 25 or 26, electrical discharge does not occur between the male conductor 25 or 26 and the powder container 27, but instead occurs between the turned portion 44*a* or 45*a* and the metal shell 24 since there is no insulating substance in the passages 48 and 49 and the distance e between the turned portion 44*a* or 45*a* and the metal shell 24 is shorter than the distance D between the male conductor 25 or 26 and the powder container 27.

Figure 6A:
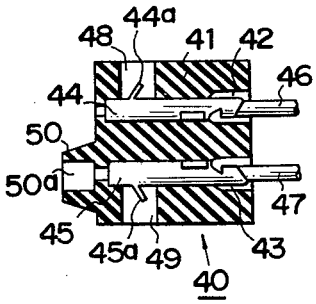
FIGS. 6A and 6B are sectional views showing the female connector of the coupling structure.
Figure 6B:
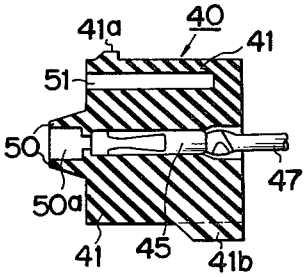
Figure 6C:
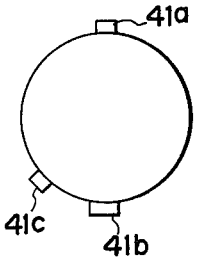
FIG. 6C is an end view of the female connector.

Referring to FIGS. 6A to 6C, the second connector 40 will be further described. A forward tapered portion 50 is formed on the front surface of the insulating socket 41 and is formed with a cylindrical recess 50*a* communicating with the conductor hole 43 for receiving the front metal member 31 of the filter 30 when the second connector 40 is engaged with the first connector 20. The insulating socket 41 is formed on its outer periphery with a lock projection 41*a* and guide projections 41*b* and 41*c* for engagement with the guide grooves 24*a*, 24*b* and 24*c* of the metal shell 24, respectively. A longitudinally-extending hole 51 is formed in the insulating socket 41 near the lock portion 41*a* so as to permit resilient movement of the lock projection 41*a*. The lock projection 41*a* is engaged with the circumferential groove 24*d* of the metal shell 24 to lock the second connector 40 in engagement with the first connector 20.

Figure 5C:
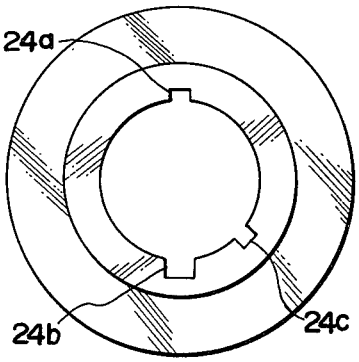
FIG. 5C is an end view of the male connector.

As shown in FIGS. 2A and 2B, when the second connector 40 is in full engagement with the first connector 20, the tapered projection 50 is fitted on the front metal member 31 to bring the portions 23*c* of the spring member 23 out of contact with the front metal member 31 thereby breaking the electrical connection between the male conductors 25 and 26 of the first connector 20. At this time, the male conductors 25 and 26 are fitted in the female conductors 44 and 45 of the second connector 40, respectively. Since the grooves 24*b* and 24*c* (FIG. 5C) are plugged with the projections 41*b* and 41*c* (FIGS. 6*b* and 6*c*), the metal shell 24 cannot be removed from the support 38 without removal of the second connector 40. To disengage the second connector 40 from the first connector 20, a special tool may be inserted into the guide groove 24*a*.

With the coupling structure of the present invention, the male electrical conductors of the first connector are automatically connected or disconnected when the second connector is disengaged or engaged with the first connector.

The invention has been described in detail with reference to a preferred embodiment thereof, but it will be understood that variations and modifications can be effected within the spirit and scope of the invention. For example, the inwardly-turned portions of the spring member may be associated with one of the male conductors to make and break an electrical connection therebetween. If desired, the filter may be provided on one of the female conductors of the second connector, in which case, a suitable means is required to connect the other female conductor with the first electrode of the filter. In addition, the passages 48 and 49 may be formed on the first connector.

What is claimed is:

1. In an igniter having a heat generator responsive to an ignition signal from an ignition signal source for igniting powder in a container, the combination comprising:

a first connector which includes a first pair of electrical conductors and first insulating support means for supporting said first pair of electrical conductors, one end of each of said first pair of conductors being connected to said heat generator, the other end of each of said first pair of electrical conductors being structurally adapted to electrically connect to a second pair of electrical conductors on a second connector;

filter means in electrical circuit with one of said first pair of electrical conductors for passing substantially only an ignition signal electrically fed through said one of said first pair of conductors;

resilient means electrically connecting said first pair of electrical conductors with each other, said resilient means resiliently contacting at least one of said first pair of electrical conductors;

a second connector which includes a second pair of electrical conductors and second insulating support means for supporting said second pair of electrical conductors, one end of each of said second pair of conductors being connected to said ignition signal source, the other end of each of said second pair of electrical conductors being structurally adapted to electrically connect to said first pair of electrical conductors when said second connector is connected to said first connector; and means for engaging said second connector with said first connector so that said second pair of conductors electrically engages said first pair of conductors and said resilient means is removed from contact with said first pair of conductors.

2. The combination set forth in claim 1 wherein said filter means includes a filter comprising: a front metal member; a rear metal member; a magnetic core disposed between said front metal member and said rear metal member; a dielectric hollow cylinder surrounding said magnetic core; a first electrode on the outer periphery of said dielectric cylinder; a second electrode having an annular portion between the magnetic core and the dielectric cylinder; and a third electrode having an annular portion between the magnetic core and the dielectric cylinder and spaced from the annular portion of the second electrode, said one of said first pair of electrical conductors extending through said front metal member, said magnetic core and said rear metal member so that the magnetic core surrounds said one conductor.

3. The combination as set forth in claim 2 wherein said second electrode includes a flange adjacent one end surface of said dielectric hollow cylinder and said third electrode includes a flange adjacent the other end surface of said dielectric hollow cylinder.

4. The combination as claimed in any one of claims 1, 2 or 3 wherein said resilient means includes a spring member having a first louvered edge about the opening through which said first conductor extends and in contact with said first conductor and a second louvered edge about the opening through which said filter extends and in contact with said first electrode, and a third portion in resilient contact with said front metal member to make an electrical connection between said first pair of electrical conductors through the spring member, said electrical connection being broken when said second connector engages said first connector.

* * * * *